US006452104B1

(12) United States Patent
Engelmann et al.

(10) Patent No.: US 6,452,104 B1
(45) **Date of Patent: *Sep. 17, 2002**

(54) ELECTRIC CABLE

(75) Inventors: Rolf Alfred Engelmann, Weltwitz; Winfried Hübscher, Weimar, both of (DE)

(73) Assignee: EM Kunststofftechnik GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/505,521

(22) Filed: Feb. 17, 2000

(30) Foreign Application Priority Data

Feb. 17, 1999 (DE) ..... 199 06 563

(51) Int. Cl.[7] ..... H01R 4/00
(52) U.S. Cl. ..... 174/84 R; 174/84 C
(58) Field of Search ..... 174/84 C, 78, 174/74 R, 84 R, 85; 439/98, 877, 882

(56) References Cited

U.S. PATENT DOCUMENTS

| | | | | | |
|---|---|---|---|---|---|
| 3,857,995 | A | * | 12/1974 | Wyrick | 174/84 |
| 3,953,103 | A | * | 4/1976 | Mathis | 339/276 T |
| 4,053,703 | A | * | 10/1977 | Smith | 174/78 |
| 5,030,111 | A | * | 7/1991 | Eastman | 439/452 |
| 5,645,039 | A | * | 7/1997 | Egger et al. | 125/21 |
| 5,749,756 | A | * | 5/1998 | Vockroth et al. | 439/879 |
| 6,120,316 | A | * | 9/2000 | Allgaier et al. | 439/404 |

* cited by examiner

*Primary Examiner*—Dean A. Reichard
*Assistant Examiner*—William H. Mayo, III
(74) *Attorney, Agent, or Firm*—R W Becker & Associates; R W Becker

(57) ABSTRACT

An electric cable is provided that is intended for securement to a connection element. The cable is made up of a cable wire that is disposed in an insulating sleeve. The region of the cable wire that projects freely out of the insulating sleeve is compressed. The insulating sleeve is surrounded by a clamping collar, from which extends a flat tongue to the free end of the cable. The tongue or tab rests upon and is to the compressed cable region, which has a rectangular or square cross-sectional configuration.

11 Claims, 1 Drawing Sheet

ELECTRIC CABLE

BACKGROUND OF THE INVENTION

FIELD OF THE INVENTION

The present invention relates to an electric cable having a cable wire that is made of a plurality of individual wires and is disposed in a sleeve or tubing of insulating material. The sleeve is spaced from an end of the cable that is to be connected, and the cable wire is compressed in a region that freely extends beyond the sleeve.

Such a compressed region is provided in order to ensure that transfer resistance at the connection locations are as small as possible. For this reason, the conductor elements or individual wires disposed at the compression location are also interconnected, for example by welding. Although this compression of the cable wire has the aforementioned advantages, there exists the danger of wire breakage, and in particular due to dynamic and vibrational stress, especially in the transition area between the compressed and non-compressed portions of the cable wire.

It is therefore an object of the present invention to prevent wire breakage in the aforementioned transition area, and hence to improve the dynamic capacity or capability of the cable connection.

BRIEF SUMMARY OF THE INVENTION

The object of the present invention is realized by a cable having a clamping collar or other crimping device that surrounds and is securely tightened on the cable, preferably being pressed into the sleeve; a tab made of conductor material extends from the clamping collar, axially to the cable, to the free end thereof, with the tab resting upon the compressed region of the cable wire. In this connection, the tab or tongue is expediently fixedly connected with the compressed region of the cable wire, preferably by means of welding. In addition, this tab should practically extend to the free end of the compressed section of the cable wire, and preferably should also have a width that corresponds to that of the compressed region.

The tab on the one hand and the clamping collar on the other hand are advantageously integrally or monolithically embodied. This ensures not only a fixed connection between the tab and the clamping collar, which serves as a holder, but in addition if these two elements are a single piece they can be mounted in common. This means that when the clamping collar is pinched or crimped onto or into the softer material of the sleeve, the tab is at the same time also securely anchored. After such a mounting, the compression of the cable wire, for example, by resistance. welding, and hence also the securement of the tab on the compressed region of the cable wire, can be carried out, with the compression generally being accomplished in such a way that the compressed region of the cable wire has a preferably rectangular or square cross-sectional configuration.

Further specific features of the present invention will be described in detail subsequently.

BRIEF DESCRIPTION OF SEVERAL VIEW OF THE DRAWINGS

Figure 2:
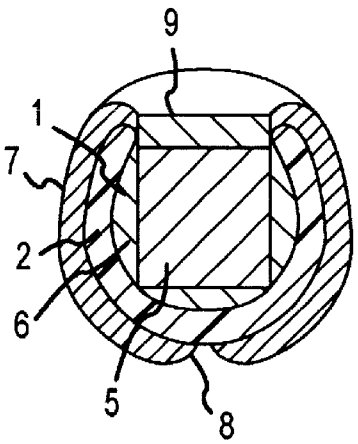
Figure 1:
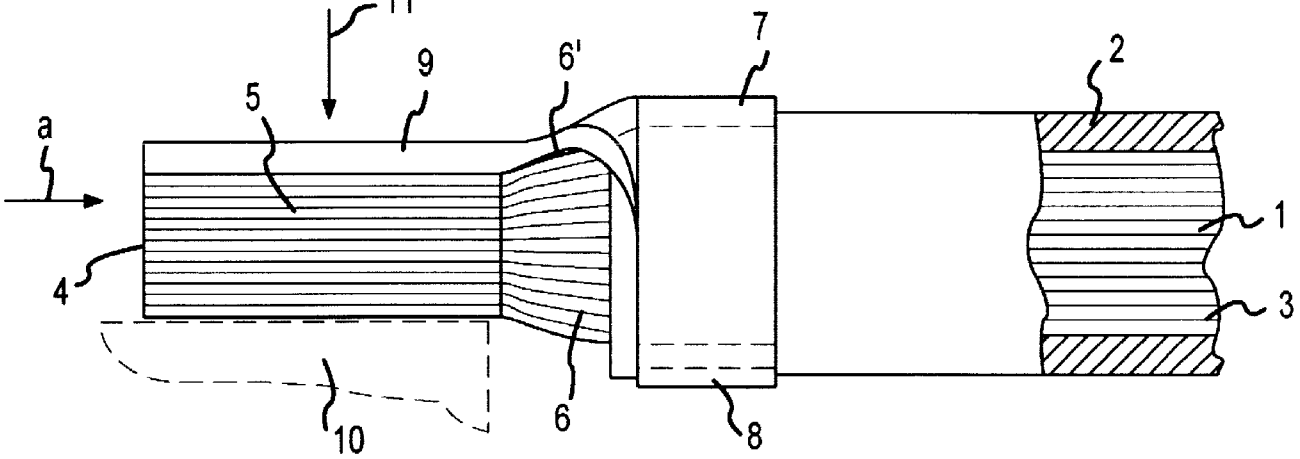

This object and advantages of the present invention, will appear more clearly from the following specification in conjunction with the accompanying schematic drawing, in which FIG. 1 discloses a partially side view of the end region of the embodiment of the electric cable, and;

FIG. 2 discloses a cross sectional end view of the end region of the electric cable of FIG. 1 taken in the direction of the arrow "a" thereof.

DETAILED DESCRIPTION OF THE INVENTION

Referring now to the drawing in detail, the electric cable illustrated therein comprises a cable wire 1 of copper or the like, and forms the electrical conductor, and furthermore comprises a sleeve or tubing 2 that closely surrounds the cable wire 1 and is made of a soft, elastically deformable polymeric material that acts as an insulator. The cable wire 1 can, for example, have a diameter of about 3–5 mm. In addition, the cable wire 1 is formed from a large number of fine wires 3, which have a diameter of about 0.05–0.21 mm, preferably approximately 0.07 mm. The cable is thus flexible.

The sleeve 2 ends at a distance from the free end 4 of the cable. The forward region 5 of the cable end that projects out is provided for the cable connection and is compressed; in contrast to the remainder of the cable wire 1, which is round, the compressed region 5 has a square or rectangular cross-sectional configuration. The transition from the non-compressed portion of the cable wire to the compressed region 5 is designated by the reference numeral 6.

The end region of the sleeve 2 is surrounded by a metallic clamping collar 7 that is comprised of a conductor material and that is firmly pressed into the wall of the sleeve; at the bottom, the collar 7 has a pinched-in section 8.

Monolithically connected to the clamping collar 7 is a tab 9 that bridges the transition area 6 and rests against that section of the compressed region 5 that is opposite the pinched-in section 8 thereof. In addition, the tab 9 has a width that corresponds to the width of the compressed region 5 and is flush with the cable at the free end 4 thereof. In the vicinity of the transition area 6, the tab 9 is preferably slightly spaced from the transition area; this spacing is indicated by the reference numeral 6'.

Together with the compaction or compression of the region 5, the tab 9 is preferably also connected to this region 5. A fixed connection is then provided, and in particular by means of resistance welding, although the tab 9 could also rest loosely upon the region 5. A loose support has the advantage that the compression for forming the region 5 can already be effected prior to applying the clamping collar 7 with its tab 9. An alteration of position cannot occur because the clamping collar 7 together with the tab 9 are fixedly mounted, i.e. are non-displacably disposed relative to the region 5.

After assembly of the cable end that is to be connected in the aforementioned manner, the end of the cable can be connected with a cooperating or connection element 10. For this purpose, the prepared cable end is placed upon the cooperating element 10; a welding operation or the like is then effected, for example by means of an electrode that acts in the direction of the arrow 11, thereby bringing about a resistance weld or the like.

The important thing is that due to the placement or mounting of the clamping collar 7 that carries the tab 9, the transition between the region 5 and the following portion of the cable wire 1 within the sleeve 2 is constructed in such a way that breakage of the cable in this transition area is practically precluded. After securement of the region 5 by welding or the like, the clamping collar 7 is a kind of elastic mounting for that end of the electric cable that faces the connection location. Bending or breaking off can therefore not occur; rather, adequately large bending radii occur for the fixedly connected electric cable.

The present invention is preferably directed to those types of electric cables where the connecting ends thereof are fixedly secured by welding or similar types of connections. It should also be noted that in contrast to the illustration of FIG. 1, the tab 9 could also be disposed at the bottom, in other words during assembly could be disposed between the connector 10 and the region 5 as a support. This particular embodiment can even be preferred in a number of instances. In general, it should also be noted that the tab 9 should not extend perpendicular or at an angle, but rather parallel to the support surface, in other words to the connector 10. Furthermore, it is to be understood that the term clamping collar refers to all types of crimping means. The important thing, however, is that the tab 9 be flat and planar so that it can rest correspondingly flat.

The specification incorporates by reference the disclosure of German priority document 199 06 563.2 of Feb. 17, 1999.

The present invention is, of course, in no way restricted to the specific disclosure of the specification and drawing, but also encompasses any modifications within the scope of the appended claims.

What we claim is:

1. A flexible electric cable, comprising a cable wire comprising a plurality of individual wires forming an electrical conductor;

a sleeve made of insulating material, wherein a portion of said cable wire is disposed within said sleeve such that said sleeve does not extend to an end of said cable wire and said end of said cable wire extends beyond said sleeve, wherein said end of cable wire is compressed, and forms a compressed end for connection: and a clamping collar securely tightened on said sleeve and surrounding a portion thereof, said clamping collar having a pinched-in section, wherein a tab made of conductor material extends from said clamping collar, parallel to said cable wire, to said compressed end of said cable wire, and wherein said tab rests directly upon said compressed end of said cable wire on a section of said compressed end of said cable wire that is opposite the pinched-in section of said clamping collar.

2. An electric cable according to claim 1, wherein said clamping collar and said tab are a monolithic component.

3. An electrical cable according to claim 1, wherein an end of said tab remote from said clamping collar is practically flush with said compressed end of said cable wire.

4. An electric cable according to claim 1, wherein said tab has a width that corresponds essentially to a width of said compressed end of said cable wire, wherein said compressed end has a rectangular or square cross-sectional configuration.

5. An electric cable according to claim 1, wherein said tab is fixedly connected to said compressed end of said cable wire.

6. An electric cable according to claim 5, wherein said tab is welded to said compressed end.

7. An electric cable according to claim 1, wherein said tab bridges a transition area between said sleeve and said compressed end of said cable wire, and wherein said tab is slightly spaced from said transition area.

8. An electric cable according to claim 1, wherein said tab is a planar body that is connected to an upper or lower surface of said compressed end of said cable wire.

9. An electric cable according to claim 8, wherein said tab, upon connection of said compressed end of said cable wire by means of welding, serves as a support member upon a connector.

10. An electric cable according to claim 1, wherein said cable wire is adapted to be welded to a connector.

11. An electric cable according to claim 1, wherein said clamping collar is pressed into said sleeve.

* * * * *